US008485522B2

(12) United States Patent
Schererz et al.

(10) Patent No.: US 8,485,522 B2
(45) Date of Patent: Jul. 16, 2013

(54) TRANSFER DEVICE FOR MAIL ITEMS

(75) Inventors: Holger Schererz, Rehfelde (DE); Rolf-Peter Skrdlant, Überlingen (DE); Bertram Wanner, Meersburg (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 13/081,729

(22) Filed: Apr. 7, 2011

(65) Prior Publication Data

US 2011/0180372 A1 Jul. 28, 2011

Related U.S. Application Data

(63) Continuation of application No. 12/507,380, filed on Jul. 22, 2009, now abandoned.

(30) Foreign Application Priority Data

Jul. 22, 2008 (DE) ..... 10 2008 034 179

(51) Int. Cl.
*B65H 43/04* (2006.01)

(52) U.S. Cl.
USPC ..... 271/198; 271/2; 271/294; 271/273

(58) Field of Classification Search
USPC 271/2, 198, 294, 273, 274; 198/626.3–626.6, 198/592; 209/900
See application file for complete search history.

(56) References Cited

U.S. PATENT DOCUMENTS

| | | | | |
|---|---|---|---|---|
| 4,130,275 | A * | 12/1978 | Rozga | 271/251 |
| 5,131,643 | A * | 7/1992 | Graveson et al. | 271/2 |
| 5,267,826 | A * | 12/1993 | Peters | 414/789.9 |
| 5,496,024 | A * | 3/1996 | Luethi et al. | 271/273 |
| 5,855,368 | A * | 1/1999 | Middelberg et al. | 271/272 |
| 2008/0041698 | A1 * | 2/2008 | Schererz et al. | 198/463.3 |

* cited by examiner

*Primary Examiner* — Jeremy R Severson

(57) ABSTRACT

A transfer device for mail items with a transfer unit which has an ejection point for transferring individualized mail items to an item carrier is provided. Further, the transfer device includes a transport device for transporting the mail items to the ejection point in a direction of transport. The transport device includes two belts for holding the mail items on both sides and for transporting the mail items and further has means for adapting a space between the belts to the thickness of a mail item. The means for adapting is a belt tilt means which is pivotal about an axis of rotation, the pivotal movement pivoting one of the belts and therefore a distance between the belts is variable.

10 Claims, 3 Drawing Sheets

TRANSFER DEVICE FOR MAIL ITEMS

CROSS REFERENCE TO RELATED APPLICATIONS

This application is a continuing application of U.S. patent application Ser. No. 12/507,380 filed Jul. 22, 2009 now abandoned, which claims priority of German patent application no. 10 2008 034 179.7 DE filed Jul. 22, 2008. All of the applications are incorporated by reference herein in their entirety.

FIELD OF INVENTION

The invention relates to a transfer device for mail items, having a transfer unit which has an ejection point for transferring the individualized mail items to an item carrier and a transport device for transporting the mail items to the ejection point in a direction of transport, which includes two belts, for holding the mail items on both sides and transporting them, and a means for adapting the spacing between the belts to the thickness of a mail item.

BACKGROUND OF INVENTION

Mail items, such as letters, large letters, postcards, wrapped journals, flat packets and the like, are sorted by their address in mail centers or large post offices in very large numbers and are deposited in a plurality of containers. For this, DE 10 2005 059 601 B3 discloses a sorting installation in which the mail items are transported, standing upright on their longitudinal edge, in a direction of transport to a ring of pigeonholes moving past transversely to the direction of transport. The mail items are shot one after the other into the pigeonholes, which move past horizontally, with the high cycle rate and the high density of the stream of items supplied having the effect that a very small time window is available each time for shooting a mail item into a pigeonhole as it moves past.

To increase the size of this time window somewhat, the stream of items is transported to the pigeonhole ring in a loading arm, it being possible for the ejection point thereof at which the mail items are transferred from the loading aim to the individual pigeonholes to be entrained horizontally with the moving pigeonholes. Once a mail item has been shot into a pigeonhole the loading arm is retracted and the ejection point aligned with a succeeding pigeonhole.

SUMMARY OF INVENTION

It is an object of the present invention to provide a transfer device by means of which mail items of differing thickness can be reliably transferred to moving pigeonholes of an item carrier.

This object is achieved by a transfer device of the type mentioned in the introduction, in which the means for adapting the spacing between the belts is a belt tilt means which is pivotal about an axis of rotation and whereof the pivotal movement pivots one of the belts and so makes its distance from the other belt variable. It is a simple matter to press in controlled manner against the belt tilt means, this controlled contact pressure being a crucial parameter for achieving satisfactory quality of transport of the mail items through the transport device with at most a low level of slip.

Adapting the spacing between the belts to the thickness of a mail item which is currently being transported may be achieved by adjusting the pivot angle from the outside, for example using a processing means, or a self-adjustment mechanism of the belt tilt means. The belt tilt means may have a deflection roller, preferably directly at the ejection point, which deflects the pivotal belt, in particular at the outermost position of the belt—that is to say where the belt is guided the furthest toward the item carrier. The deflection roller may, together with the deflected belt, be pivotal about the axis of rotation of the belt tilt means arranged outside the deflection roller. The ejection point may be a location on the transfer unit at which the mail items leave the transfer unit, for example by way of a chute or to guided transfer to the adjacent item carrier. The belts are preferably motorized endless belts. For further guidance of the mail items, the transfer unit may have an additional underlying belt on which the mail items stand on their longitudinal edge as they are transported by the two belts. The mail items may be mailings of all kinds. The item carrier may take the form of a pigeonhole ring with revolving pigeonholes.

So that the ejection point can be entrained in a manner adapted to movement of the item carrier, the transfer unit advantageously includes an entraining drive which is controlled by a processing means. The ejection point may be entrained, temporarily synchronized with a movement of the item carrier which is in particular transverse in relation to the direction of transport, where "transverse" is understood below to mean an angle of between 70° and 110°. After a synchronized entrainment of this kind, the transfer unit can be pivoted back, with the high cycle rate of the transported mail items making it possible for a high moment of acceleration to act on the transfer unit and hence also on the entrained belt tilt means.

The transport device should be capable of transporting mail items of the greatest variety of thicknesses in a manner at least substantially free of slip even under considerable lateral acceleration, in particular of up to 6 g. To this end, in a preferred embodiment of the invention, the belt tilt means includes a compensation means which, in the event of acceleration of the ejection point both in the direction of and in opposition to a movement of the item carrier, acts to counter any closing or opening of the belts caused by inertia. By compensating fully or at least to a large extent for any movement of the belt tilt means and hence one of the belts caused by inertia, it is possible to prevent the belts from closing or opening—that is to say moving toward one another or away from one another—if the transfer unit is forcefully accelerated. Depending on the construction of the compensation means or transfer unit, any relationship between closing and opening and the direction of acceleration is possible.

The compensation means may be electronically controlled or self-regulating, for example with the aid of a sensor. A particularly simple and reliable means is a counterweight which acts to counter any movement of inertia by the other components of the belt tilt means as a result of its own inertia. The counterweight may be a counterweight to the mass of the belt tilt means on the ejection side, and be mounted opposite the ejection point in relation to the axis of rotation. Advantageously, it is connected to the ejection point with the aid of a rigid aim, with the result that dynamic movements are kept small.

The belt tilt means is advantageously arranged with its axis of rotation such that any movement of the belt tilt means caused by acceleration in the direction of acceleration of the ejection point is fully or partly compensated in the direction transverse to the direction of transport. The transfer unit, which may take the faun of a loading arm, may be moved transverse to the direction of transport without any disadvantage, as a result of which a considerable degree of freedom of movement in relation to the item carrier can be achieved.

Particularly good compensation of movements of the belt tilt means caused by acceleration can be achieved if the center of gravity of the belt tilt means lies on the axis of rotation.

To keep transport of a mail item between the belts as free of slip as possible, the two belts have to be pressed toward one another and toward the mail item by a contact pressure force so that the mail item is held securely between them. This contact pressure force may be applied by one or more spring elements. The occurrence of wear associated with the contact pressure force may be countered if the form of the belt run of the belt of the belt tilt means gives rise to the contact pressure force on the belt tilt means. The belt run of the belt of the belt tilt means is advantageously formed such that the resultants of the force of the belt gear form a force component which imparts a moment of contact pressure to the belt tilt means. To this end, a tension force of one of the belts, in particular the belt associated with the belt tilt means, may exert a closing force on the belt tilt means. An additional contact pressure on the tilt means may be applied by a spring construction.

Rarely, and for a vast variety of reasons, it may occur that proper transfer of a mail item from the transport device to the item carrier does not proceed smoothly and the mail item remains stuck in the region of the ejection point, between the item carrier and the transfer unit. As a result of continued movement by the item carrier, which it may not be possible to stop abruptly because of its weight, the mail item is pulled further and may possibly pull the entire transfer unit with it, with the result that there is a risk of damage to the mail item and the transfer unit. To prevent this, the transfer device advantageously includes a release means for opening the belt tilt means wide enough for a mail item between the belts to be released at the ejection point. The mail item may be transported further by the item carrier without the transfer unit being pulled with it. When the belt tilt means is opened at the ejection point, the belts are advantageously spaced from one another by at least 10 cm.

When the belt tilt means is opened, the contact pressure force provided for holding the mail item in the transport device has to be overcome. So that this act of overcoming the pressure is not left to the mail item, the release means advantageously has a gear for opening the belt tilt means to such an extent that a mail item is fully released in a region extending from the ejection point by at least 30 cm in opposition to the direction of transport, in a direction of acceleration of the ejection point. The direction of acceleration is advantageously the direction of transport of the item carrier. The transfer unit and the ejection point thereof may be accelerated, for example in order to position the ejection point at a succeeding pigeonhole of the item carrier, without a mail item that is jammed in the item carrier striking against the belt tilt means.

Advantageously, the opening is wide enough for it to be possible to move the mail item by a distance of at least 50 cm in the direction of acceleration without coming into contact with the belt tilt means.

Advantageously, the release means includes a motorized drive for opening the belt tilt means. A considerable force can be introduced at high speed and the belt tilt means can be particularly rapidly and widely opened.

To ensure rapid introduction of force to the belt tilt means, during opening advantageously the release means is connected to the belt tilt means without the use of a spring, with the result that the belt tilt means is opened without the use of a spring. To make a certain spring action of the belt tilt means still possible when the belt tilt means is in normal operation, advantageously the belt tilt means is pivotal somewhat in a spring means when the release means is at rest, in particular at a point where the release means acts on the belt tilt means. A spring contact pressure can have the effect that opening of the belt tilt means is resisted, in opposition to the spring contact pressure, in the first phase of jamming of a mail item, until the belt tilt means is opened beyond the initial deflection angle by actuator.

Advantageously, the belt tilt means includes a spring element for pressing the belts toward one another, for example to aid a contact pressure by the belts. Should the belt tilt means be opened by a safety function, the direction of this opening movement is in opposition to the spring pressure, with the result that in some cases the contact pressure is in opposition to the spring force and hence becomes more difficult. To avoid this, the spring advantageously acts on the transfer unit such that an opening movement of the release means has the effect of relaxing the spring. This can help the belt tilt means to open for the purpose of the safety function.

BRIEF DESCRIPTION OF THE DRAWINGS

The invention will be explained in more detail by means of an exemplary embodiment, which is illustrated in the drawings.

In the drawings.

DETAILED DESCRIPTION OF INVENTION

Figure 1:
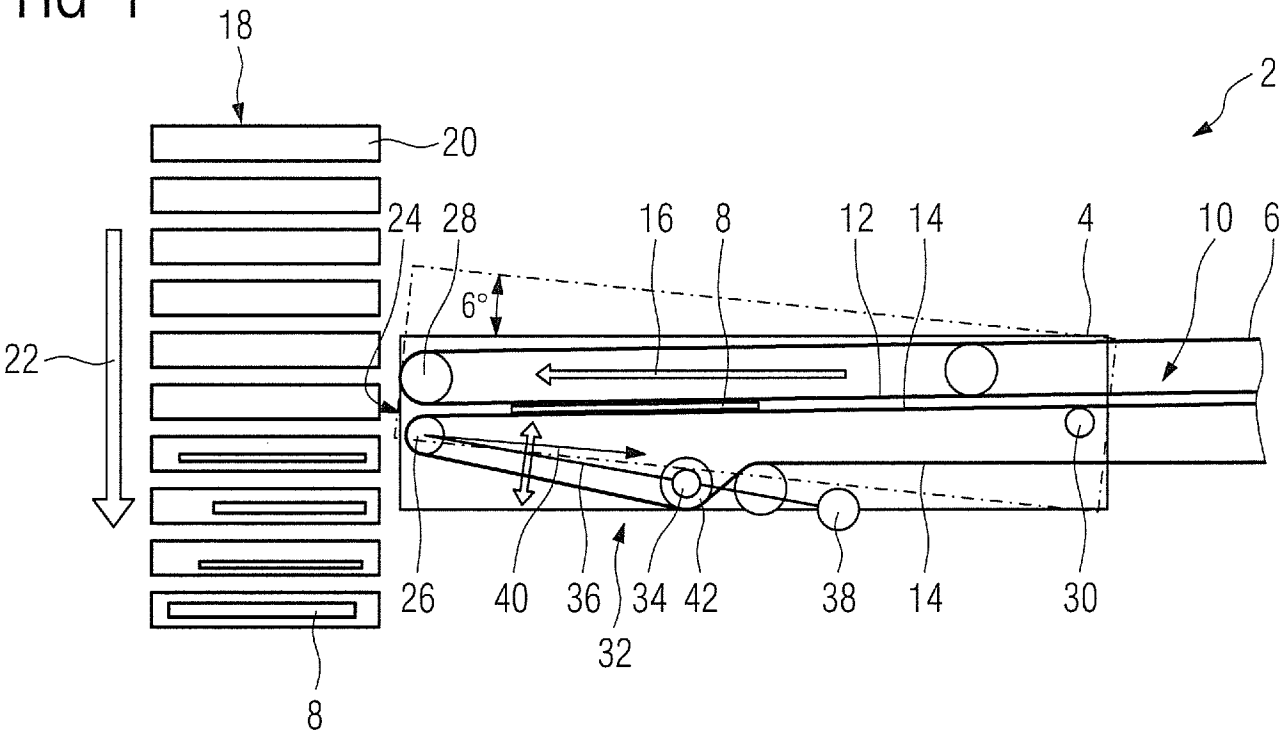
FIG. 1 shows a transfer device having a movable transfer unit, in a diagrammatic plan view.

FIG. 1 shows a transfer device 2 in a diagrammatic plan view. It includes a transfer unit 4 in the form of a loading aim which is movable, in particular pivotal, in relation to a stationary unit 6. The mobility is indicated by a broken line in which the transfer unit 4 is indicated pivoted by 6° in relation to a starting position. In its starting position, mail items 8 are transported by a transport device 10 which has two revolving belts 12, 14, in a straight line in the direction of transport 16 from the stationary unit 6 to the loading arm or transfer unit 4. Depending on the angle of pivoting of the loading aim, the path of transport is angled somewhat in the region between the stationary unit 6 and the loading arm.

At a small spacing from the transfer unit 4, there is arranged an item carrier 18 in the form of a pigeonhole ring which includes a plurality of pigeonholes or item containers 20 that are arranged one behind the other, in the form of a train, and are secured such that they are movable in relation to one another. When the transfer device 2 is in operation, the item carrier 18 moves in a carrier direction 22, which extends perpendicular to the transport direction 16 when the transfer unit 4 is untilted. Mail items 8 that are transported in the transfer unit 4 are shot one after the other into a respective pigeonhole 20, with the frontmost end of the transfer unit 4 being entrained in a manner synchronized in speed and position with the respective item container 20 into which the next mail item 8 is to be inserted.

When a mail item 8 is transferred from the transfer unit 4 to the item carrier 18, the mail item 8 leaves the transfer unit 4 at an ejection point 24 that is formed by the frontmost elements of the transfer unit 4. These elements may for example be two rollers 26, 28 with the two belts 12, 14. Once the mail item 8 is deposited fully in the desired item container 20, the transfer unit 4 is pivoted back somewhat in the clockwise direction until the ejection point 24 is positioned opposite a succeeding item container 20, so that a mail item 8 can be inserted into the latter.

The mail items 8 are transported in the direction of transport 16 by the transport device 10, at a speed of 2.5 m/s, and are inserted into the item containers 20, which move at a speed of 0.5 m/s perpendicular to the direction of transport 16. Between the individual mail items 8 there are small gaps which make it possible to align the transfer unit 4 in its new position in front of a succeeding item container 20. This re-positioning is carried out at a frequency of approximately 3 Hz. Here, in particular the front part of the transfer unit 4, together with the ejection point 24, is accelerated powerfully in a direction of acceleration that is substantially parallel or antiparallel to the carrier direction 22.

So that transport of mail items 8 of differing thickness is possible between the belts 12, 14 and in particular between the rollers 26, 28, the roller 26 and with it the front part of the belt 14 are mounted to be movable in relation to the roller 28 and the belt 12. When the transfer unit 4 is accelerated, forces of inertia act on the movable mounting, the roller 26 and the front part of the belt 14, as a result of which a contact pressure force of the belt 14 exerted on the mail item 8 that is currently being transported would vary were it not for a corresponding counter-action. This would result in too strong or too weak a contact pressure and hence in damage to the item or slipping of the mail item 8 between the belts 12, 14.

To prevent this, the front roller 26 is part of a belt tilt means 32, by means of which part of the belt 14 is mounted to be pivotal about an axis of rotation 34. The front roller 26 is secured to a rigid tilt arm 36, which is mounted on the axis of rotation 34 and carries a counterweight 38 at its end in opposition to the roller 26. The distribution of mass of the belt tilt means 32 is in this case set such that its center of gravity comes to lie on the axis of rotation 34.

In the event of the transfer unit 4 moving pivotally about its axis of rotation 30 and acceleration in or in opposition to the pivotal movement, the belt tilt means 32 is dynamically counterbalanced thereby, with the result that the forces of inertia of the individual elements of the belt tilt means 32 counteract one another and the belt tilt means 32 remains at rest even if there is considerable acceleration in relation to the other parts of the transfer unit 4, for example the roller 28. This means that a contact pressure force which presses the belt tilt means 32 and with it the belt 14 in the direction of the belt 12 remains at least substantially unaffected by the acceleration.

A contact force pressing the belt tilt means 32 in the direction of the belt 12 is created by an advantageous form of the belt run of the belt 14. The belt 14 is tensioned at a force of approximately 300 N. This force pulls the front roller 26 backward as indicated by the arrow 40. The direction of the arrow 40 is the direction of the bisector of the angle formed by the belt 14 as it is deflected by the roller 26. The alignment of the tilt arm 36, that is to say the direction of the line between the axis of rotation 34 and the axis of rotation of the roller 26, is selected such that an angle is produced between the tilt arm 36, or the line connecting the axes of rotation, and the force resultant indicated by the arrow 40. Because the line connecting the axes of rotation does not coincide with the force resultant, a torque is exerted on the belt tilt means 32, in the direction of the force resultant. This torque has the effect of exerting a contact pressure force on the belt tilt means 32, in the direction of the belt 12. The contact pressure force is for example between 10 and 20 N, depending on the angular position of the belt tilt means 32. This depends on the thickness of the mail item 8 that is currently being transported between the belts 12, 14. Closing of the belt tilt means 32, brought about by the contact pressure force, and hence clamping of the mail item 8 between the belts 12, 14, may be further reinforced by a spring element.

Arranged in the region of the axis of rotation 34 is a roller 42 which deflects the belt 14 and whereof the axis of rotation is the axis of rotation 34. As a result of this, the path of the belt 14 between the rollers 26, 42 remains the same regardless of the angular position of the belt tilt means 32. As a result of the angle between the tilt arm 36 and the direction of transport 16, when the belt tilt means 32 closes, however, the spacing between the front roller 26 and a rear roller (not illustrated) or the axis of rotation 30 becomes smaller. This means that the tension force of the belt 14 is reduced somewhat when the belt tilt means 32 closes, which has the effect of reducing the tension force of the belt 14 and hence the contact pressure force or closing force of the belt tilt means 32. This is countered by an increase in the angle between the force resultant (represented by the arrow 40) and the tilt arm 36 when the belt tilt means 32 closes, which reinforces a contact pressure force or closing force of the belt tilt means 32. Depending on the direction of the angle or the elasticity of the belt 14, these two mutually opposing effects can be balanced so that the closing force is independent of the closing angle of the belt tilt means 32 or can be adjusted to another advantageous form.

Figure 2:
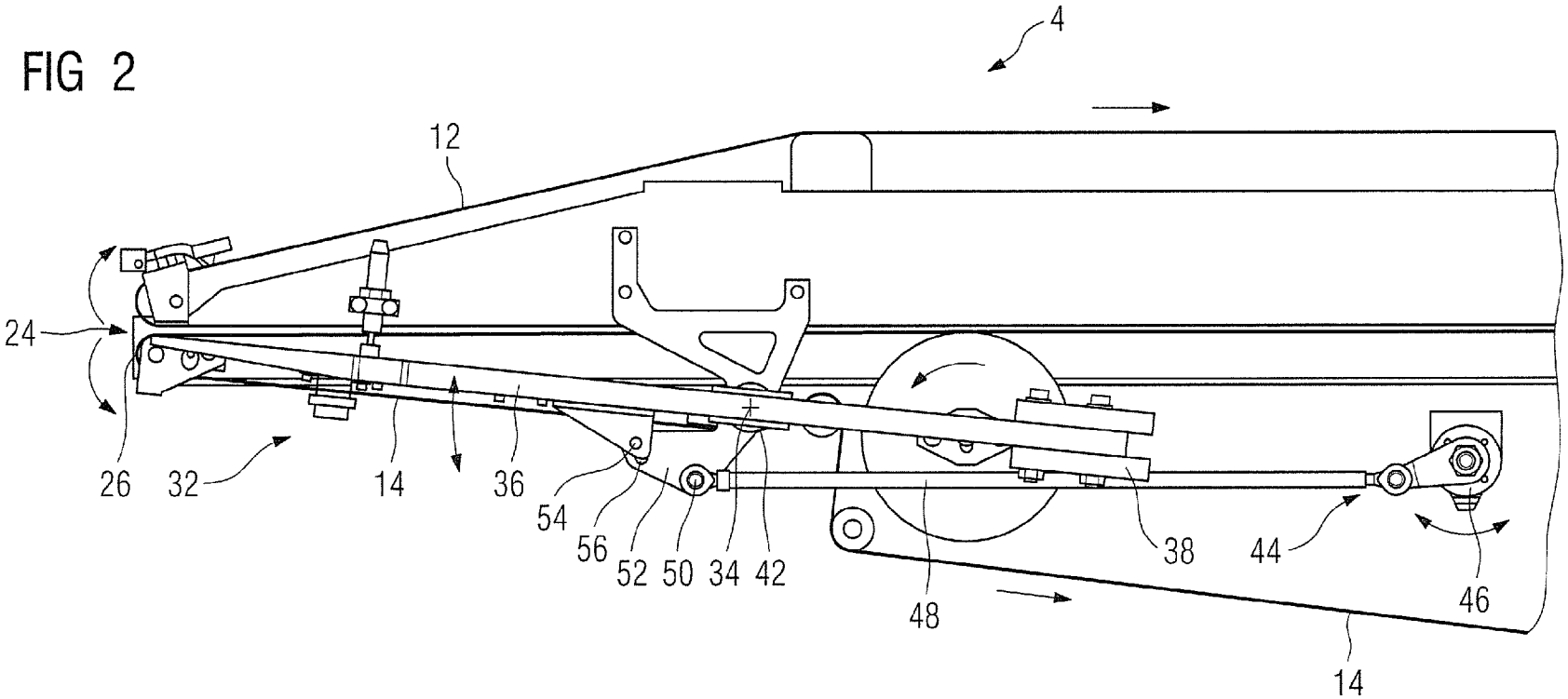
FIG. 2 shows the transfer unit in a more detailed plan view.

FIG. 2 shows the transfer unit 4 in a more detailed view from above. The belt tilt means 32 is illustrated with its tilt arm 36, the counterweight 38, its roller 26 at the ejection point 24 and its contact pressure belt 14. Also illustrated is a release means 44 with a motorized drive 46 and a gear 48 that is connected at a point of action 50 to a mounting 52 on which the tilt arm 36 is secured.

The tilt arm 36 may be pivoted slightly in relation to the mounting 52, as indicated at a pin 54 in a slot 56. When the drive 46 is at rest, the mounting 52 is mounted rigidly in relation to the drive 46, it being possible for the tilt arm 36 to pivot somewhat in order to adapt its open position to mail items 8 of differing thickness. With the aid of a spring 58, which is visible in FIG. 3, the belt tilt means 32 is pressed in the direction of its closed position, in its position illustrated in FIG. 2.

Figure 3:
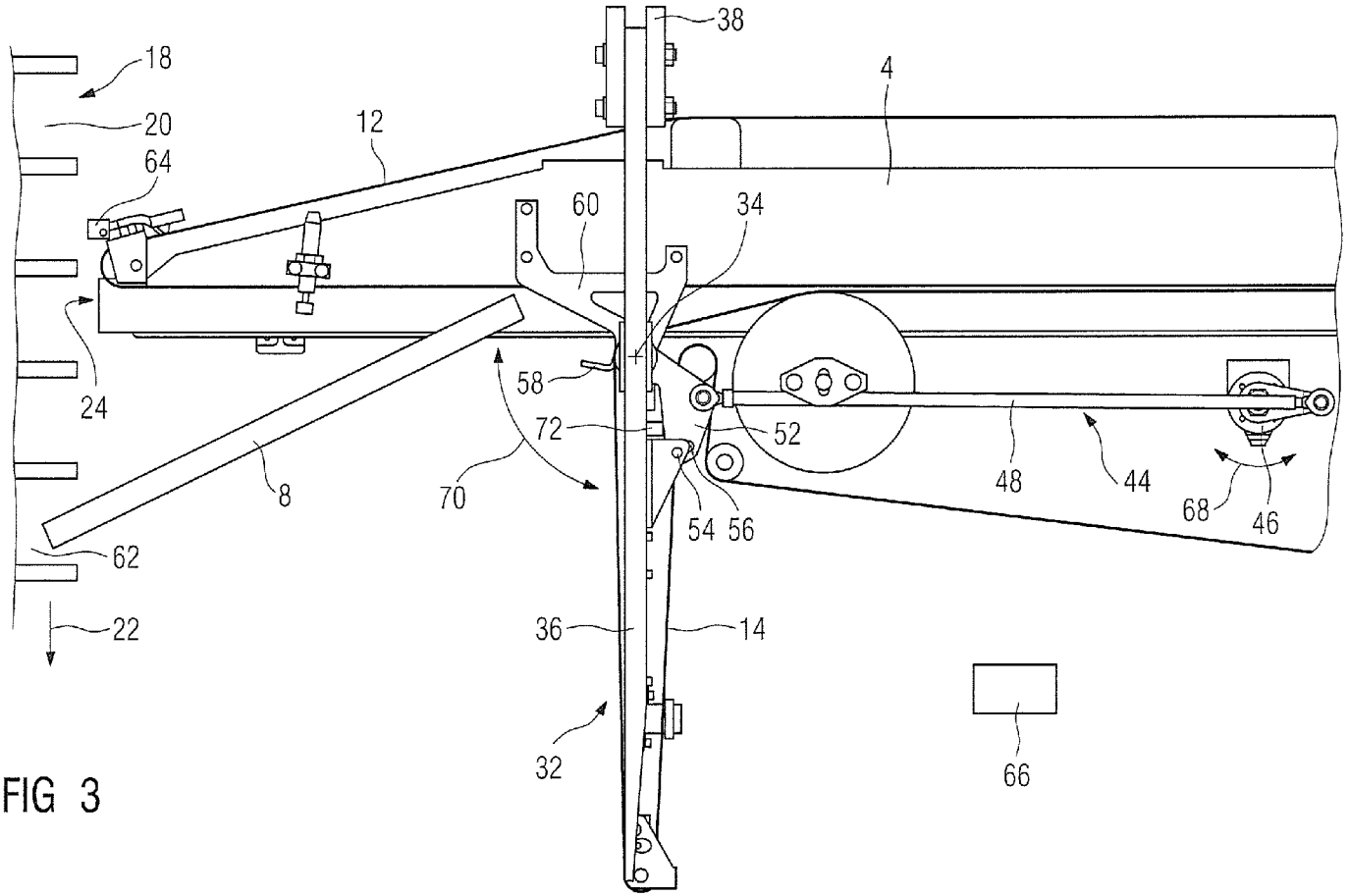
FIG. 3 shows the transfer unit from FIG. 2, with a belt tilt means fully open.

FIG. 3 shows the transfer unit 4 with the belt tilt means 32 fully open. In this position, the belt tilt means 32 is turned by more than 90° relative to the position shown closed in FIG. 2, with the contact pressure belt 14 pivoted by 90° in its region facing the mail item 8 relative to its closed position shown in FIG. 2. The spring 58 that is illustrated in FIG. 3 takes the form of a torsion spring and is wound in a spiral about the axis of rotation 34, with the end of the spring 58 that projects to the left and is visible in FIG. 3 being illustrated as pointing to the left only for the sake of the illustration to make the spring visible. In a correct illustration, the end illustrated would be secured below a mounting 60 and not visible in plan view.

FIG. 3 shows the belt tilt means 32 with the safety function actuated. The front end of a mail item 8 has left the ejection point 24 and has partly entered the interior 62 of an item container 20. There the mail item 8 has for example jammed, with the result that it is not inserted any further into the interior 62 despite a feed force effected by the belts 12, 14, which acts in the direction of the ejection point 24 and hence into the item container 20. In the meantime, the entire item carrier 18 has moved on in the carrier direction 22, entraining the ejection point 24 in synchronized manner, with the result that there is no or only a small relative movement between the interior 62 and the ejection point 24.

With the aid of a sensor 64, for example an optical sensor 64, the gap between the ejection point 24 and the item carrier 18 is scanned, the sensor 64 being connected to a processing means 66 and the processing means 66 monitoring the gap and hence the insertion of the mail item 8 into the interior 62. The processing means 66 recognizes that the for example optical measuring beam generated by the sensor 64 is still interrupted, so the mail item 8 has not yet been fully inserted into the relevant item container 20.

At a later point in time, the transfer unit 4 reaches a position in which synchronized entrainment with the item carrier 18 is normally stopped. This would have the effect that the front end of the mail item 8 would be transported further in the carrier direction 22, while the ejection point 24 is at rest or is even guided back in the opposing direction. To prevent damage caused in this way to the mail item 8 and the transfer unit 4, the processing means 66 triggers the drive 46, with the result that the latter moves the gear 48 as indicated by an arrow 68. The gear 48 acts on the mounting 52, which is form-fittingly connected to the tilt arm 36 and pulls the latter into its open position, which is shown in FIG. 3. The belt tilt means 32 is now opened, by the angle of opening 70 in relation to the closed position.

The mail item 8, which is for example 35 cm long, is fully released by this and can now be guided further in the carrier direction 22 without coming into contact with the contact pressure belt 14 or another element of the belt tilt means 32 or the transfer unit 4. This drastically reduces the risk of damage to the mail item 8 or the transfer unit 4. There is now enough time to stop the item carrier 18 and to remove the backlog of items without affecting elements of the transfer device 2.

When the belt tilt means 32 is opened to its open position, as illustrated in FIG. 3, the gear 48 moves the tilt arm 36 in opposition to the spring force of the spring 58, which is tensioned more as the angle of opening 70 increases. In another embodiment, the spring 58, which is provided to apply a contact pressure force of the belt tilt means 32 to the mail item 8 that is being transported between the belts 12, 14, may be applied by another or an alternative spring 72 which in FIG. 3 is shown diagrammatically in the form of a square between the tilt arm 36 and the mounting 52. The spring 72 presses the tilt arm 36 away from the mounting 52, with the result that in the closed position of the belt tilt means 32 a contact pressure force is exerted on the mail item 8 between the belts 12, 14 by way of the tilt arm 36 and the contact pressure belt 14.

When the drive 46 is actuated to open the belt tilt means 32, the mounting 52 can turn counter-clockwise somewhat without the form-fitting connection acting on the tilt arm 36. This turning initially relaxes the spring 72, with the result that the mutual contact pressure force on the two belts 12, 14 is reduced. During this, the spring 72 moreover helps to actuate the gear 48, since it urges in the direction of its open position. As the mounting 52 is pivoted further, the form-fitting connection acts between the mounting 52 and the tilt arm 36, with the result that the tilt arm 36 is pulled into its open position. During this the spring 72 can remain pre-tensioned somewhat so that the tilt arm 36 is guided without play.

The invention claimed is:

1. A transfer device for mail items, comprising:

a transfer unit including an ejection point for transferring the mail items to an item carrier, wherein the transfer unit comprises a loading arm which is movable about a pivot point in relation to a stationary unit;

a transport device for transporting the mail items to the ejection point, the transport device including two belts for holding the mail items on two sides and for transporting the mail items;

a belt tilt device for adapting a space between the two belts to a thickness of a mail item, the belt tilt device being pivotal about an axis of rotation, wherein a pivotal movement pivots one of the belts resulting in that a distance between the two belts is variable; and a release device for opening the belt tilt device wide enough for a mail item located between the belts to be released at the ejection point, wherein the release device includes a motorized drive for opening the belt tilt device, wherein the belt tilt device is dynamically counterbalanced around the pivot point of the transfer unit.

2. The transfer device as claimed in claim 1, wherein the belt tilt device includes a compensation acting to counter any closing or opening of the belts caused by inertia in case of an acceleration of the ejection point both in a direction of and in opposition to a movement of the item carrier.

3. The transfer device as claimed in claim 2, wherein the compensation is a counterweight.

4. The transfer device as claimed in claim 3, wherein the direction of acceleration of the ejection point is transverse to a direction of transport.

5. The transfer device as claimed in claim 2, wherein the direction of acceleration of the ejection point is transverse to a direction of transport.

6. The transfer device as claimed in claim 1, wherein a center of gravity of the belt tilt device lies on the axis of rotation.

7. The transfer device as claimed in claim 1, wherein a tension force of one of the belts exerts a closing force on the belt tilt device.

8. The transfer device as claimed in claim 1, wherein the release device has a gear for opening the belt tilt device to such an extent that a mail item is fully released in a region extending from the ejection point by at least 30 cm in opposition to the direction of transport and in a direction of the acceleration of the ejection point.

9. The transfer device as claimed in claim 8, wherein the belt tilt device is pivotal in a spring means at a point where the release device acts on the belt tilt device.

10. The transfer device as claimed in claim 1, further comprising:

a spring for pressing the belts toward one another, during which an opening movement of the release device has the effect of relaxing the spring.

* * * * *